US005799096A

United States Patent [19]

Liao

[11] Patent Number: 5,799,096

[45] Date of Patent: Aug. 25, 1998

[54] DESKTOP MICROPHONE SEAT

[76] Inventor: Lu-Lee Liao, No. 5, Shi-An South Lane, Shi-Tung District, Taichung City, Taiwan

[21] Appl. No.: 756,797

[22] Filed: Nov. 26, 1996

[51] Int. Cl.[6] ..... H04R 25/00

[52] U.S. Cl. ..... 381/169; 381/168

[58] Field of Search ..... 381/169, 168, 381/91; 403/106, 107, 93; 248/289.11; 362/427, 418, 287

[56] References Cited

U.S. PATENT DOCUMENTS 794,967 7/1905 Baird ..... 381/169

812,125 2/1906 Gharky ..... 381/169

4,975,815 12/1990 Lin ..... 362/287

*Primary Examiner*—Sinh Tran

*Attorney, Agent, or Firm*—Browdy and Neimark

[57] ABSTRACT

A desktop microphone seat comprises a base and a pivoting member. The base has a support portion with a receiving slot in which a column is rotatably recieved. The pivoting member has a plate body dimensioned to fit into the recieving slot which is provided with a first locating portion. The plate body of the pivoting member is provided with a plurality of the second locating portions engageable with the first locating portion when the pivoting member is turned on the column acting as a pivot.

13 Claims, 3 Drawing Sheets

DESKTOP MICROPHONE SEAT

FIELD OF THE INVENTION

The present invention relates generally to a desktop microphone, and more particularly to a desktop microphone seat provided with a locating structure.

BACKGROUND OF THE INVENTION

As shown in FIG. 1, a desktop microphone seat of the prior art comprises a bendable tube 2 which is fastened at one end thereof with a seat 3 and at another end thereof with a sleeve 4 which is intended to hold a microphone 5. The position of the microphone 5 can be adjusted as desired by bending the tube 2. The desktop microphone seat of the prior art described above is defective in design in that the bendable tube 2 has an elasticity capable of causing tube 2 to relocate, and that the frequent bending of the tube 2 often results in the fatigue of the tube 2. As a result, a user of the microphone 5 may have to adjust frequently the position of the microphone 5 at work.

SUMMARY OF THE INVENTION

It is therefore the primary objective of the present invention to provide a desktop microphone seat with a locating structure capable of locating the microphone with precision.

It is another objective of the present invention to provide a desktop microphone seat with a locating structure capable of stabilizing the position of the microphone.

In keeping with the principle of the present invention, the foregoing objectives of the present invention is attained by a desktop microphone seat, which comprises a base, and a pivoting member. The base has a support portion with a receiving slot in which a column is disposed. The pivoting member has a plate body dimensioned to fit into the receiving slot which is provided with a first locating portion. The plate body of the pivoting member is provided with a plurality of second locating portions. The microphone seat is therefore provided with a plurality of locating angles when the pivoting member is turned on the column serving as a pivot.

The foregoing objectives, features, functions, and advantages of the present invention will be more readily understood upon a thoughtful deliberation of the following detailed description of the embodiment of the present invention in conjunction with the accompanying drawings.

DETAILED DESCRIPTION OF THE INVENTION

Figure 1:
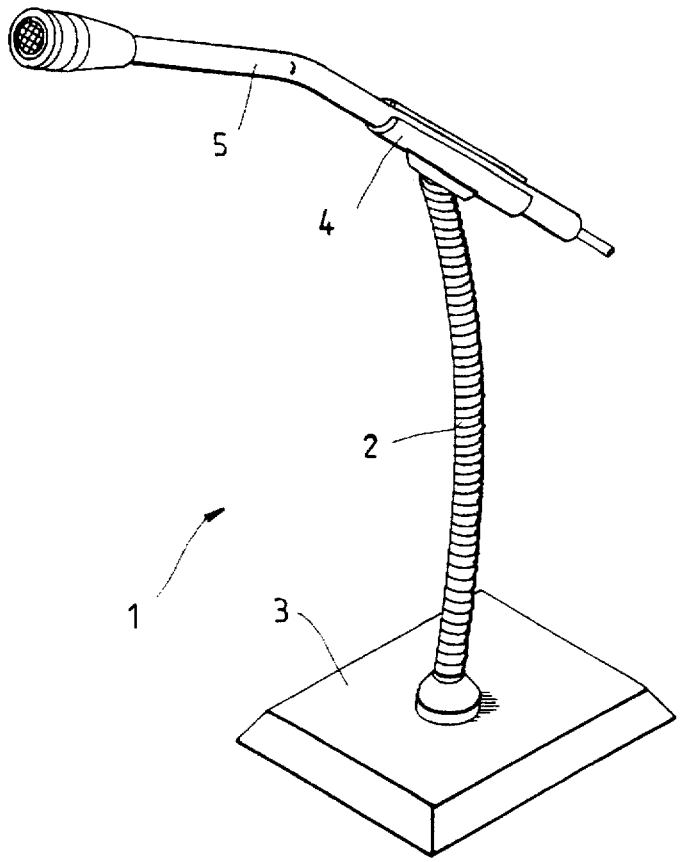
FIG.1 (PRIOR ART)
FIG. 1 shows a perspective view of a desktop microphone seat of the prior art.
Figure 2:
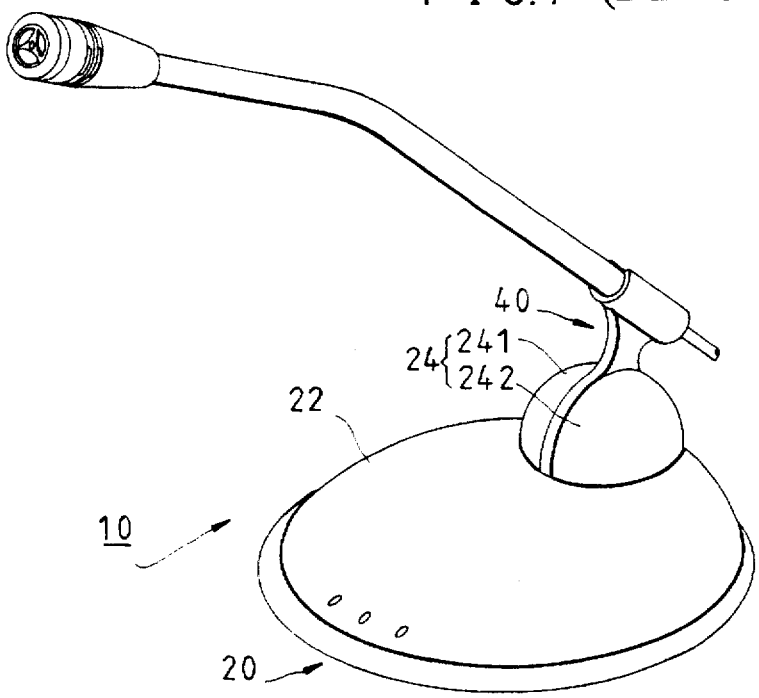
FIG. 2 shows a perspective view of a desktop microphone seat of the present invention.
Figure 3:
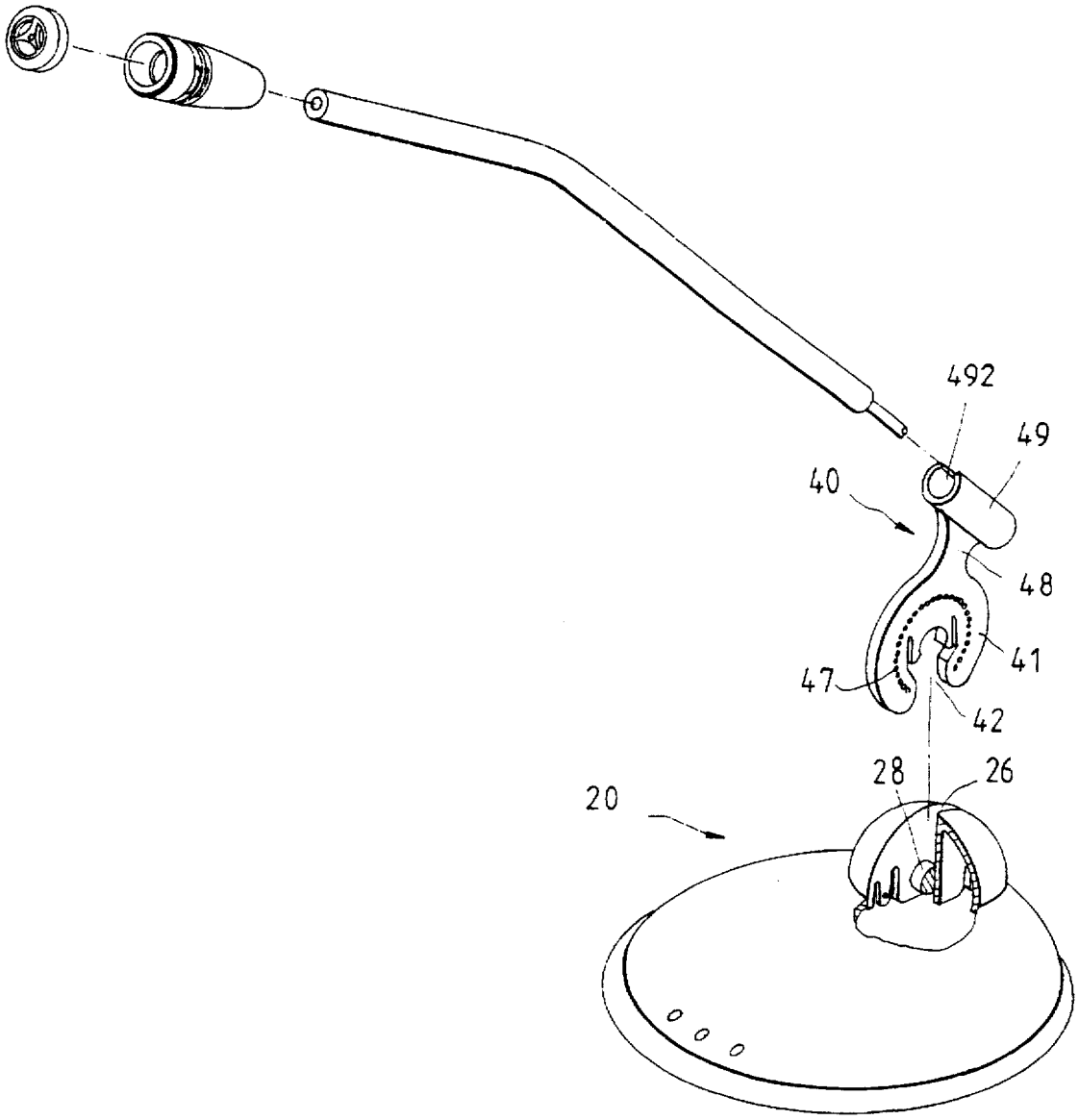
FIG. 3 shows an exploded view of the desktop microphone seat of the present invention.
Figure 4:
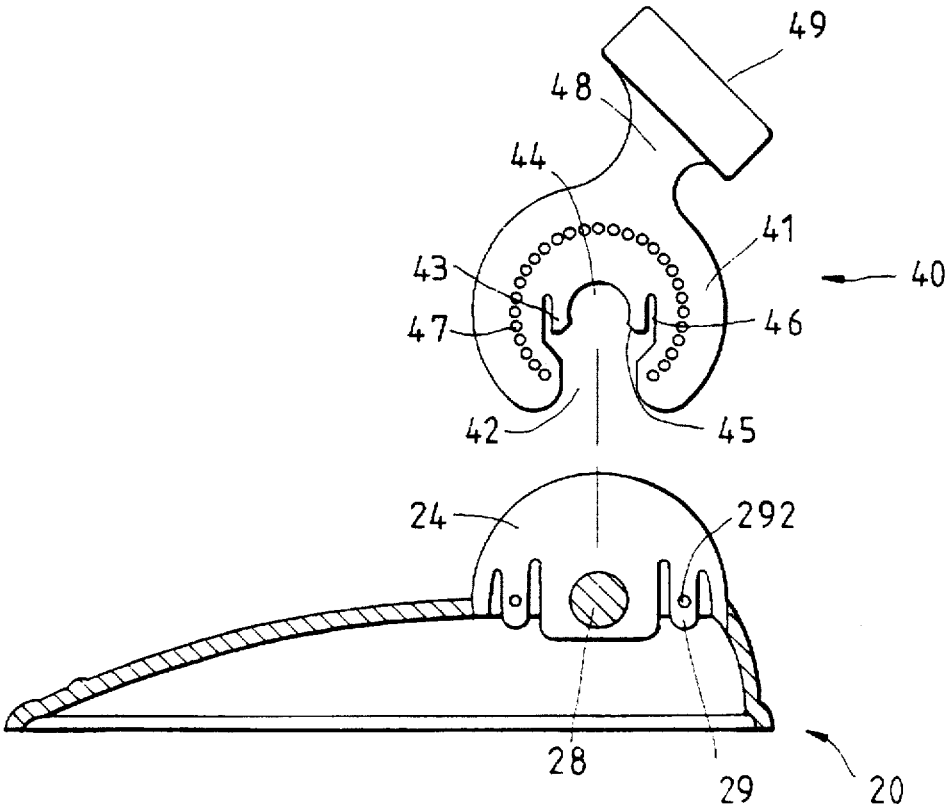
FIG. 4 shows a right planar view of the desktop microphone seat of the present invention.
Figure 5:
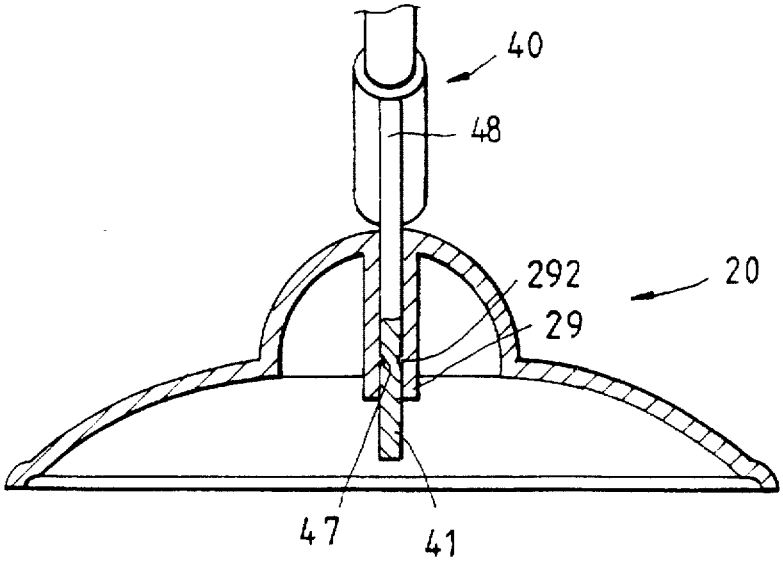
FIG. 5 shows a rear planar view of the desktop microphone seat of the present invention.

As shown in FIGS. 2–5, a desktop microphone seat 10 embodied in the present invention is composed of a base 20 and a pivoting member 40.

The base 20 has an arcuate top 22, a semicircular support portion 24 made integrally with the arcuate top 22, a receiving slot 26 extending from the top of the support portion 24 to divide the support portion 24 into a left support portion 241 and a right support portion 242, and a column 28 disposed in the receiving slot 26 such that the axis of the column 28 is spaced an equal distance from two locating projections 29 each locating projection 29 having a tongue with an axis parallel to the axis of the column 28 and capable of swinging along the direction of the axis of the column 28.

The pivoting member 40 has a round plate 41 dimensioned to fit into the receiving slot 26. The round plate 41 is provided with a recess 42 having two retaining legs 43 symmetrical to each other and extending from the bottom of the recess 42 towards the open end of the recess 42. An arcuate recess 44 is located between the bottom of the recess 42 and the surface between the two retaining legs 43. The arcuate recess 44 has a cross section which is substantially equal in circular locus to the cross section of the column 28. The width of the open end of the arcuate recess 44 is slightly smaller than the circumferential length of the circular locus and the outer diameter of the column 28. The open end of the arcuate recess 42 is provided with two guide angles 45. The two retaining legs 43 are provided respectively with a cavity 46. The free ends of the two retaining legs 43 are capable of swinging flexibly. The plate 41 is provided with a plurality of locating cavities 47 which are complementary to one, another and corresponding to tongues 292 on the locating projections 29. The plate 41 is further provided at the top thereof with an inclined neck 48 which is in turn provided with a receiving seat 49 for holding a microphone. The receiving seat 49 embodied in the present invention is a sleeve having an axial hole 492.

In combination, the plate 41 is inserted into the receiving slot 26.

In the meantime, the column 28 can be easily inserted into the arcuate slot 44, thanks to the guidance of the guide angles 45 and the flexible motion of the retaining legs 43. The column 28 is received securely in the arcuate recess 44 in view of the fact that the width of the open end of the arcuate recess 44 is smaller than the outer diameter of the column 28. In addition, the pivoting member 40 is provided with a plurality of locating angles when the pivoting member 40 is rotated on the column 28 serving as a pivot, thanks to the cooperative engagements of the tongues 292 on locating projections 29 with the locating cavities 47. It is suggested that both tongues 292 and the locating cavities 47 are of an arcuate construction.

In operation, the microphone rod is inserted into the axial hole 492 of the receiving seat 49 and is subsequently adjusted for a desired position by turning the pivoting member 40. The turning of the pivoting member 40 can be easily brought about in view of the fact that the tongues 292 are capable of swiveling flexibly along the direction of the axis of the column 28, and that the locating projections are capable of moving between two adjoining cavities 47.

The present invention has inherent advantages over the prior art in view of the fact that the former can be assembled and disassembled easily without the use of a hand tool, and that the former can be located with precision and stability, and further that the former can be dismantled for easy storage.

The embodiment of the present invention described above is to be regarded in all respects as being merely illustrative and not restrictive.

Accordingly, the present invention may be embodied in other specific forms without deviating from the spirit thereof. The present invention is therefore to be limited only be the scopes of the following appended claims.

What is claimed is:

1. A desktop microphone seat comprising:

a base provided with a support portion having a receiving slot, said base further provided with a column received in said receiving slot such that said column is positioned and spaced by a predetermined distance from each of two first flexible locating portions engaged in said receiving slot; and a pivoting member having a plate body capable of being fitted into said receiving slot of said base, said plate body provided with an arcuate recess dimensioned to receive rotatably therein said column, said plate body further provided with a receiving seat for holding a microphone, and with a plurality of second locating portions engageable with said two first flexible locating portions of said base when said pivoting member is rotated on said column serving as a pivot.

2. The desktop microphone seat as defined in claim 1, wherein each of said two first flexible locating portions has an arcuate tongue; and wherein each of said plurality of second locating portions are arcuate recesses corresponding to each said arcuate tongue.

3. The desktop microphone seat as defined in claim 1, wherein said arcuate recess has a cross section with a circular locus substantially equal to a cross section of said column.

4. The desktop microphone seat as defined in claim 3, wherein said arcuate recess has an opening with a width smaller than a circumferential length of said circular locus and an outer diameter of said column.

5. The desktop microphone seat as defined in claim 3, wherein said arcuate recess is provided with at least one guide angle.

6. The desktop microphone seat as defined in claim 3, wherein said plate body is provided with at least one cavity; and wherein said plate body is provided with a retaining leg located between said cavity and said arcuate recess such that said retaining leg is capable of swinging flexibly.

7. The desktop microphone seat as defined in claim 3, wherein said plurality of second locating portions are adjacent to one another along said circular locus.

8. The desktop microphone seat as defined in claim 1, wherein said receiving seat of said plate body is a round tube having an axial hole.

9. The desktop microphone seat as defined in claim 1, wherein said receiving seat is fastened with said plate body by a neck.

10. A desktop microphone seat comprising:

a based provided with a support portion having a receiving slot, said base further provided with a column received in said receiving slot such that an axis of said column spaced an equal distance from each of two first flexible locating portions engaged in said receiving slot;

a pivoting member having a plate body capable of being fitted into said receiving slot of said base, said plate body provided with an arcuate recess dimensioned to receive rotatably therein said column, said plate body further provided with a receiving seat for holding a microphone, and with a plurality of second locating portions engageable with said two first flexible locating portions of said base when said pivoting member is rotated on said column serving as a pivot;

said arcuate recess having a cross section with a circular locus substantially equal to a cross section of said column; and said arcuate recess having an opening with a width smaller than a circumferential length of said circular locus and an outer diameter of said column.

11. The desktop microphone seat as defined in claim 10, wherein each of said two first flexible locating portions has an arcuate tongue; and wherein each of said plurality of second locating portions are arcuate recesses corresponding to each said arcuate tongue.

12. The desktop microphone as defined in claim 10, wherein said arcuate recess is provided with at least one guide angle.

13. The desktop microphone seat as defined in claim 10, wherein said plurality of second locating portions are adjacent to one another along said circular locus.

* * * * *